United States Patent [19]

Alexander

[11] 3,936,087

[45] Feb. 3, 1976

[54] COLLECTION RECEPTACLE

[76] Inventor: William R. Alexander, 223 Rambling Way, Springfield, Pa. 19064

[22] Filed: Oct. 15, 1974

[21] Appl. No.: 514,588

[52] U.S. Cl. ..... 294/1 R; 15/257.1; 248/99

[51] Int. Cl.[2] ..... A47F 13/06; A47L 13/52

[58] Field of Search ..... 15/104.8, 257.1, 257.3, 15/257.4, 257.7, 257.8, 257.9; 220/1 T, 17, 63 R; 232/43.1, 43.2, 43.3, 43.4, 43.5; 248/95, 97, 99, 100, 101; 294/1 R, 19, 55; D7/181, 183–186, 189, 191–193

[56] References Cited

UNITED STATES PATENTS

| | | | |
|---|---|---|---|
| 3,170,183 | 2/1965 | Leatherman | 15/257.1 |
| 3,659,891 | 5/1972 | Pettenon et al. | 294/1 R X |
| 3,688,483 | 9/1972 | Hamilton | 294/19 R X |
| 3,697,030 | 10/1972 | Schulz | 15/251.1 X |
| 3,747,653 | 7/1973 | Ringer | 248/99 X |
| 3,754,785 | 8/1973 | Anderson | 294/19 R |
| 3,765,143 | 10/1973 | Ippolito et al. | 220/63 R UX |
| 3,804,448 | 4/1974 | Schmieler | 294/1 R X |
| 3,830,423 | 8/1974 | Prescott | 15/104.8 X |

FOREIGN PATENTS OR APPLICATIONS

| | | | |
|---|---|---|---|
| 527,972 | 11/1957 | Italy | 15/257.7 |
| 916,849 | 8/1954 | Germany | 15/257.1 |

*Primary Examiner*—Roy D. Frazier
*Assistant Examiner*—Lawrence J. Staab

[57] ABSTRACT

A collection receptacle for gathering leaves, twigs and the like for use with a plastic bag which includes an open cylindrical base having a scraper tray attached thereto and extending therefrom with integral handles and with a handle mounted to the base opposite the tray. A plastic bag is carried outside the cylindrical base and is retained thereon by frictional engagement between the handle and base and tray and base. The receptacle is preferably formed of three pieces of sheet plastic preferably retained in assembled condition by pins or a suitable adhesive, the nature of the securing determining the capability of disassembly for storage.

6 Claims, 5 Drawing Figures

10
11
4
27
26
33
16
39
38
32
35
30
39
34
4
38
31

17
21
18
19
20
21
25
41
14

27
26
28
20
33
39
38
32
30
35
16
20
39
34
31
38

12
14
16
21
30
20
26
27
19
25
38
39

FIG. 5
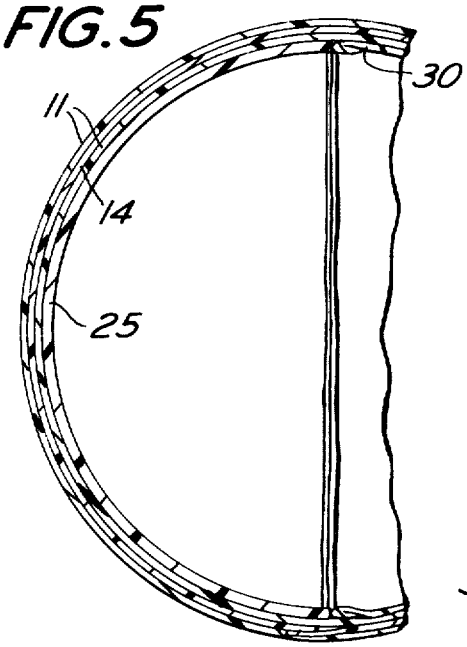
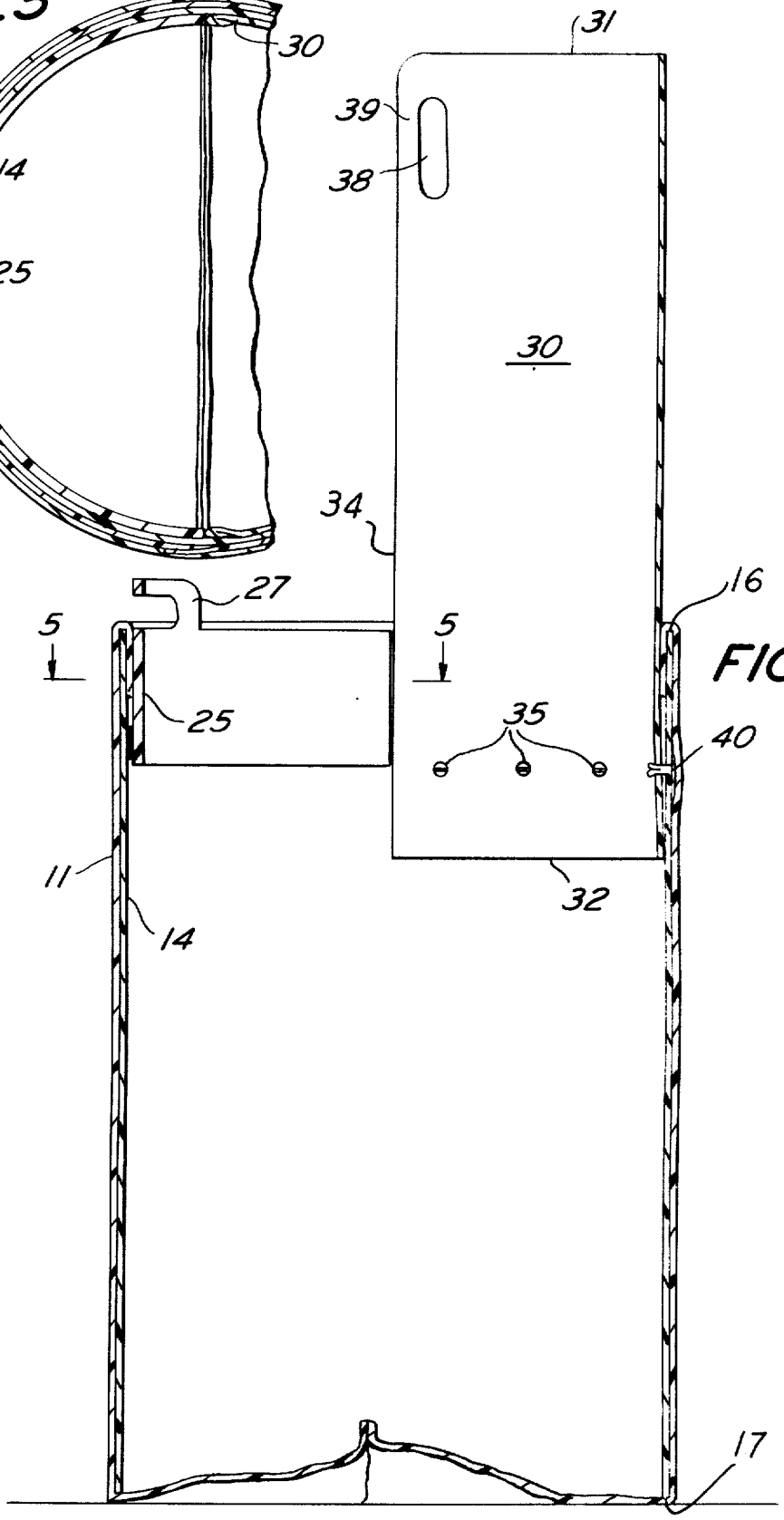
FIG. 4

COLLECTION RECEPTACLE

BACKGROUND OF THE INVENTION

1. Field of the Invention

This invention relates to a collection receptable of the open end collapsible type for use with plastic collection bags.

2. Description of the Prior Art

Many receptacles or carriers have been provided for use with plastic bags for collecting of leaves, twigs or other debris. Most of the receptacles presently available suspend the plastic bag from its open end, require the user to lift the debris into the bag and do not protect the bag from damage while loading and carrying.

The receptacle of my invention can be used as desired and as required in either a vertical or in a horizontal position, protects the bag during filling and carrying, and provides many other advantages not available in previously available receptacles.

SUMMARY OF THE INVENTION

A receptacle for the collection of debris in combination with a plastic bag which includes a cylindrical base open at the ends with a scraper tray affixed to and extending from the cylindrical base, the tray having hand hold openings and a hand hold opening for the base carried by a stiffener rib portion opposite the tray, with a bag locking action provided between the base and the tray and the stiffener rib portion and base to retain a plastic bag thereon during pick up and transportation of debris.

The principal object of the invention is to provide a receptacle that is simple to use and is labor saving.

A further object of the invention is to provide a receptacle that can be shipped in unassembled condition, easily assembled by the user and disassembled for storage.

A further object of the invention is to provide a receptacle that can be used with different sizes of bags.

A further object of the invention is to provide a receptacle that is simple to fabricate but is durable and of long service life.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 4 is a vertical sectional view, enlarged taken approximately on the line 4—4 of FIG. 1, and FIG. 5 is a fragmentary horizontal sectional view, still further enlarged, taken approximately on the line 5—5 of FIG. 4.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
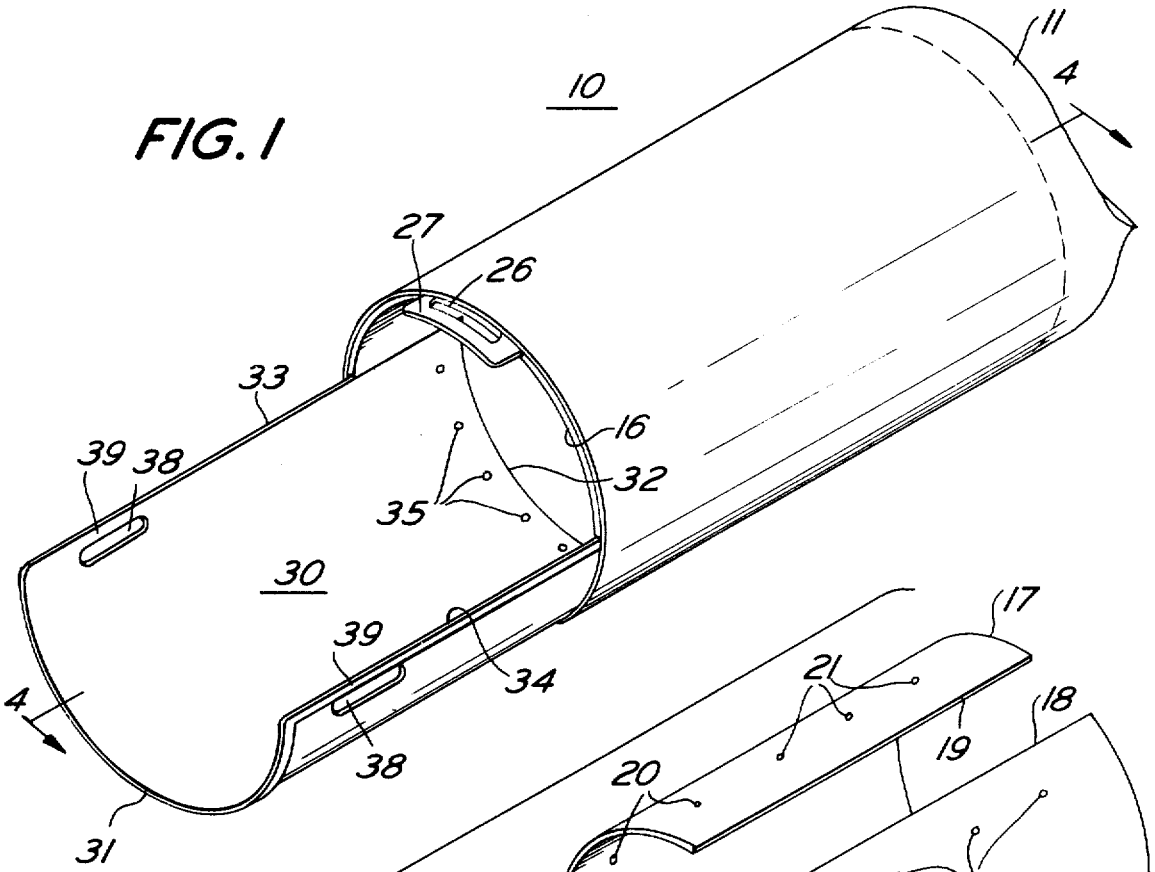
FIG. 1 is a perspective view of the receptacle of the invention with a bag thereon in position for debris loading.

Referring now more particularly to the drawings the collection receptacle 10 is illustrated in FIG. 1 with a leaf and garden bag 11 engaged therewith. The bag used with the collection receptable, in a preferred embodiment, is of three mil thick vinyl plastic with a circumference of 66 inches and a height of 48 inches. Large bags of 72 inches circumference are also popular and can be used with the same size receptacle. Other bags 11 capable of assembly to the collection receptacle 10 as herein described can also be employed.

Figure 2:
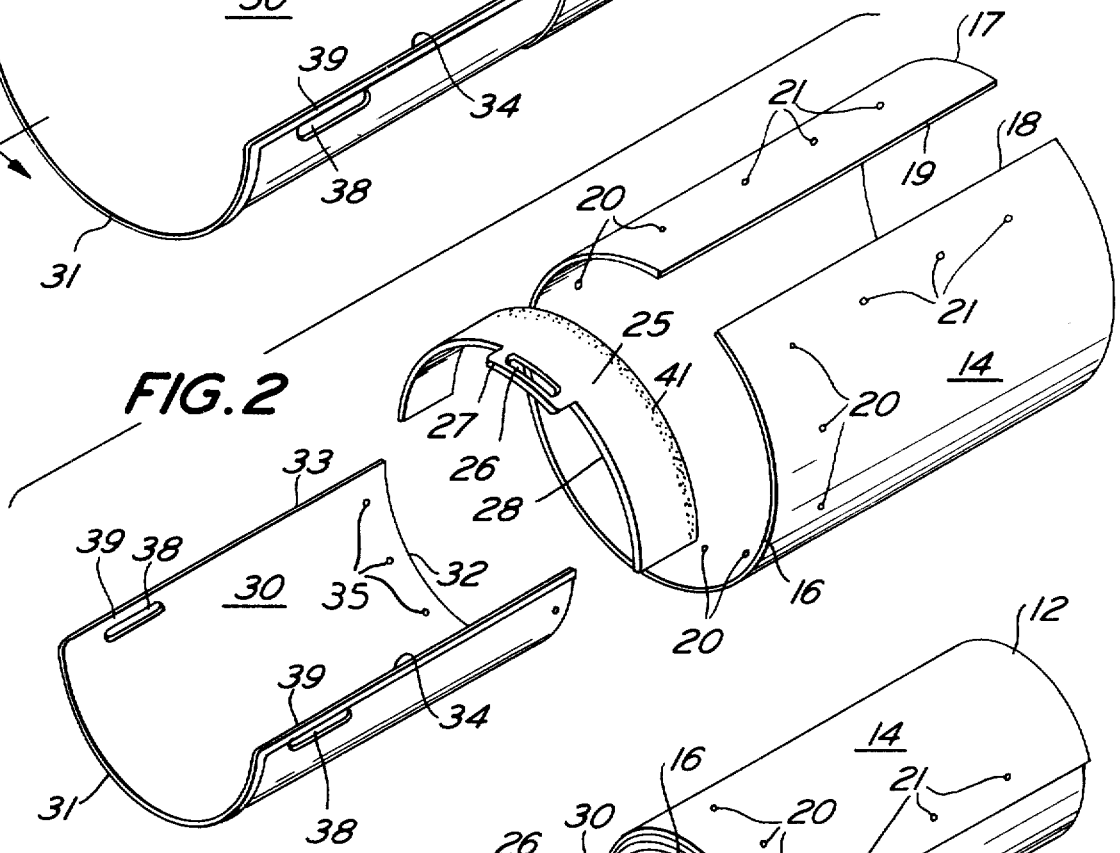
FIG. 2 is an exploded perspective view illustrating the component parts of the receptacle.
Figure 3:
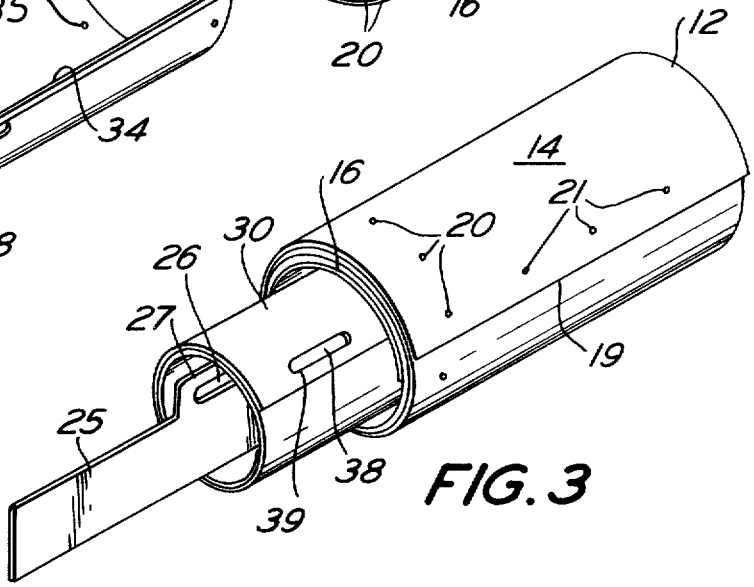
FIG. 3 is a perspective view illustrating the component parts of the receptacle ready for shipping or storage.

The collection receptacle 10 in unassembled condition as shown in FIG. 2 has a base portion 14 of generally rectangular shape with top and bottom edges 16 and 17 and side edges 18 and 19. A row of holes 20 is provided adjacent the top edge 16, and rows of holes 21 adjacent the side edges 18 and 19 are provided.

A stiffener rib portion 25 is provided of generally rectangular shape in flat unassembled condition as shown in FIG. 2 which includes a cut out 26 to form a hand hold opening 27 above its top edge 28. The stiffener rib portion 25 is advantageously of a thicker gauge material than the base 14 and in a preferred embodiment may have a thickness twice that of the base portion 14.

A scraper tray 30 is also illustrated in FIG. 2 preferably of rectangular or square configuration in flat unassembled condition with top and bottom edges 31 and 32 and side edges 33 and 34.

A row of holes 35 may be provided adjacent the bottom edges 32.

The scraper tray 30 has its edges 31, 33 and 34 rolled back to provide a stiffening action to resist cracking and tearing along the edges.

Openings 38 are provided adjacent the edges 31, 33 and 34 providing hand holds 39 for facilitating movement of the tray 30 by the user.

The base 14, rib portion 25 and the tray 30, in a preferred embodiment, are formed of polyethlene sheet material of well known type. Other suitable materials resistant to moisture and to handling and of adequate strength can be used if desired.

Referring now to FIGS. 1, 4 and 5 the receptacle 10 is shown in assembled condition. The base 14 is shown as having been unrolled and the holes 21 adjacent side edges 18 and 19 aligned and clips 40 have been inserted into the holes 21 to retain the base 14 together and form a cylinder open at the ends. If it is not desired to disassemble the base 14 a band of adhesive may be substituted for the clips 40 adjacent the edges 18 and 19 to hold the edges in permanent secured relation.

The rib portion 25 has a band of adhesive 41 applied thereto adjacent its bottom edge and the rib 25 is bent and forced down inside the base 14 until the edge 28 is even with the top edge 16 of base 14. The rib portion 25 can be secured to the inside of base 14 along the line of adhesive 41 or can be held with clips 40.

The scraper tray 30 is bent and inserted into the base 14 until holes 35 are aligned with the holes 20 in base 14, and clips 40 are then inserted into holes 20 and 35 to retain the tray 30 in assembled relation to base 14.

If desired, where disassembly is not required, a band of adhesive may be substituted for the clips 40 adjacent the holes and no higher than a line extending around the base 14 at the height of holes 20. The edges 18 and 19 of the tray 30 meet the ends of the rib portion 25.

In use, a plastic bag 11 is pulled up over the outside of cylindrical base 14 until it reaches the top of handle 27. The free end of the bag 11 is then folded over the top edge 16 of the base 14 and inserted between the tray 30 and the rib portion 25 where it is retained by the pressure exerted by the base 14, rib 25 and tray 30. The user can then place the tray 30 in a horizontal disposition on the ground and rake or shovel debris into the tray 30 and base 14. The debris can be settled in the bag 11 by lifting the tray 30 and base 14 to a vertical position by the hand hold openings 39 which causes the debris to pack down inside the base 14 and bag 11.

If desired, the receptacle 10 can be lifted and transported by use of the hand hold openings 27 or 39. When the base 14 is full of debris or when desired the receptacle 10 can be lifted to a vertical position, the end of bag 11 can be withdrawn from its engagement between tray 30 and base 14 and rib portion 25 and base 14, and disposed of as desired. A new bag 11 can be placed on base 14 as before and the operation repeated as described.

It should be noted that during use the bags 11 are securely retained on the base 14 and that no contact is made with the bag 11 (except at the bottom) while loading which considerably reduces the likelihood of damage to the bag.

It will thus be seen that a collection receptacle has been provided with which the objects of the invention are attained.

I claim:

1. A collection receptacle for use with a plastic bag which comprises a semi-rigid self-supporting base open at its ends formed of a sheet of flexible material rolled and detachably secured together along its length to form a cylinder, a scraper tray carried by said base and extending from one end thereof, hand hold means on said receptacle, and bag holding means comprising overlapped portions of said hand hold means and said scraper tray with said base for reception of an end portion of said bag in assembled relation of said bag with respect to said base.

2. A collection receptacle as defined in claim 1 in which said hand hold means includes a rib portion engaged with said base which provides additional stiffening action to retain the base in a cylindrical configuration in loading position.

3. A collection receptacle as defined in claim 1 in which said receptacle is composed of a plurality of assembled components, one of said components being said cylindrical base comprised of a rectangular sheet of flexible material secured together along a pair of opposite edges, and another of said components in said scraper tray comprised of a substantially rectangular sheet of flexible material secured to and extending from said base in a hemi-cylindrical shape.

4. A collection receptacle as defined in claim 2 in which said bag holding means comprises a bag end receiving and retaining space between said base and said tray at the end of said base adjacent said scraper tray.

5. A collection receptacle as defined in claim 2 in which said bag holding means comprises a bag end receiving and retaining space between said base and said rib portion at the end of said base adjacent said scraper tray.

6. A collection receptacle as defined in claim 5 in which another of said components is comprised of a stiffening rib secured to said base at the end adjacent said scraper tray.

* * * * *

UNITED STATES PATENT OFFICE

CERTIFICATE OF CORRECTION

Patent No. 3,936,087 Dated February 3, 1976

Inventor(s) William F. Alexander

It is certified that error appears in the above-identified patent and that said Letters Patent are hereby corrected as shown below:

Column 4,

Line 21, (Line 9 of Claim 3) after "components", "in" should be - is -.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*